US006630240B2

(12) United States Patent
Yoshimura et al.

(10) Patent No.: US 6,630,240 B2
(45) Date of Patent: Oct. 7, 2003

(54) BULKY POLYESTER MULTIFILAMENT COMPOSITE YARN AND PROCESS FOR PRODUCING THE SAME

(75) Inventors: Mie Yoshimura, Matsuyama (JP); Katsuyuki Kasaoka, Matsuyama (JP); Koichi Iohara, Matsuyama (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 10/221,313

(22) PCT Filed: Jan. 9, 2002

(86) PCT No.: PCT/JP02/00057

§ 371 (c)(1),
(2), (4) Date: Sep. 11, 2002

(87) PCT Pub. No.: WO02/055771

PCT Pub. Date: Jul. 18, 2002

(65) Prior Publication Data

US 2003/0129393 A1 Jul. 10, 2003

(30) Foreign Application Priority Data

Dec. 1, 2001 (JP) ..... 2001-004785

(51) Int. Cl.[7] ..... D01F 6/00; D01F 6/92; D02G 3/24

(52) U.S. Cl. ..... 428/364; 428/372; 428/395; 428/398; 428/400; 264/103; 264/210.8; 264/210.5; 264/342 RE; 264/210.14

(58) Field of Search ..... 428/364, 372, 428/395, 398, 400; 264/172.17, 210.8, 210.5, 342 RE, 210.14, 211.12, 103

(56) References Cited

U.S. PATENT DOCUMENTS 6,136,435 A * 10/2000 Yoshimura et al. ..... 428/372
6,503,622 B1 * 1/2003 Yoshimura et al. ..... 428/364

FOREIGN PATENT DOCUMENTS

| | | |
|---|---|---|
| JP | 3-137237 | 6/1991 |
| JP | 4-245940 | 9/1992 |
| JP | 7-324241 | 12/1995 |
| JP | 11-1836 | 1/1999 |
| JP | 2002212848 A * | 7/2002 |

* cited by examiner

*Primary Examiner*—N. Edwards
(74) *Attorney, Agent, or Firm*—Sughrue Mion, PLLC

(57) ABSTRACT

A bulky polyester multifilament composite yarn having a delicate hand and an appropriate bulkiness, which comprises two types of polyester filaments FA and FB differing from each other in average filament length, the FA being formed from a polyester resin containing 0.1 to 9.0% by mass of a micropore-forming agent (e.g., a polyoxyalkylene polyether, a metal organic sulfonate, a metal-containing phosphorus compound, and the like) and 0.5 to 5.0% by mass of a residual elongation improver (e.g., a polymer of methyl methacrylate, a polymer of a styrene compound, a polymer of a methylpentene compound, and the like) based on the mass of the polyester-resin, the FA having an average filament length that is from 1.07 to 1.40 times the average filament length of the FB, and the FA forming the peripheral portion of the composite yarn.

7 Claims, No Drawings

BULKY POLYESTER MULTIFILAMENT COMPOSITE YARN AND PROCESS FOR PRODUCING THE SAME

TECHNICAL FIELD

The present invention relates to a bulky polyester multifilament composite yarn and a process for producing the same. Particularly, the present invention relates to a bulky polyester multifilament composite yarn comprising two types of polyester filaments differing from each other in average single filament length, in which the polyester filaments having a larger average single filament length contain a micropore-forming agent to cause the composite yarn to exhibit a high bulkiness and a good hand, and a high productivity and process stability in production thereof, and a process for producing the same.

BACKGROUND ART

A bulky synthetic multifilament textured yarn has heretofore been produced by simultaneously drawing and false twisting and/or drawing a raw yarn comprising at least two types of multifilaments differing in drawability, thermal shrinkage and/or elastic recovery from each other. In the conventional process, differences of the elongation and/or thermal shrinkage among the at least two types of multifilaments are utilized, and differences of the multifilament length among the types of multifilaments in the composite yarn are enlarged. As a result, gaps among individual filaments in the resultant multifilament yarn are enlarged, and filaments having a shorter length and a portion of filaments having a longer length form the core portion of the multifilament yarn; the remainder of the filaments having a longer length are bulged outward from the core portion to form a sheath portion. Consequently, the bulkiness of the multifilament yarn is significantly increased.

A woven or knitted fabric formed from a bulky multifilament yarn has recently been required to be still more improved in delicate hand, touch, appearance. In order to meet the requirements, the properties of the sheath portion of the multifilament yarn forming the surface portion of the bulky yarn woven or knitted fabric must be improved.

Various investigations have therefore been carried out to effect modification of a filament-forming polymer so that the following can be realized: (1) further thinning each of the filaments forming the sheath portion; and (2) manifestation of a desired hand of filaments for forming the sheath portion. The following procedures have been known as means for the modification of a polymer mentioned above: a polyester polymer is made to contain a micropore-forming agent, or a polyester polymer is modified with a micropore-forming agent; a multifilament yarn is produced from the resultant micropore forming agent-containing or modified polyester; a desired woven or knitted fabric is produced from the multifilament yarn; and the multifilament yarn or the woven or knitted fabric is subjected to a weight-reduction treatment with an alkali to improve the hand of multifilaments. The alkali weight reduction forms many fine craters caused by the trace of the micropore-forming agent removed from the surface of the individual filament. As a result, the treated multifilament yarn, or woven or knitted fabric has improved dry touch, a draping property and a creaky (Kishimi) hand.

The modified polyester multifilament yarn or woven or knitted fabric thereof as explained above has been industrially highly evaluated as a fiber material having a special and new hand. However, when individual multifilaments for forming the sheath portion are required to be further thinned (e.g., 1.0 dtex or less), particularly when the multifilaments contain a micropore-forming agent, the process stability of the production of multifilaments having thin individual filament thickness from the modified polyester containing the agent decreases, and the production efficiency is lowered. Moreover, the efficiency of manifesting the effect of improving the hand with the micropore-forming agent decreases.

As a result of intensively investigating the causes of the above problems, the inventors of the present invention have found that the process stability decreases during the production of a bulky composite yarn containing, as a sheath portion, filaments that contain a micropore-forming agent and that the effect of improving the hand of the resultant composite yarn decreases for the reason that during melt spinning filaments for the sheath portion, the micropore-forming agent contained therein is thermally decomposed to deteriorate the polyester and/or form foreign particles by aggregation.

DISCLOSURE OF THE INVENTION

The present invention is intended to provide a bulky polyester multifilament composite yarn containing, as a filament component for forming the sheath portion, polyester filaments that contains a micropore-forming agent and having an excellent hand, and a process for producing the composite yarn with high productivity and process stability.

As a result of investigating means for preventing the deterioration of polyester during melt-spinning polyester multifilaments containing a micropore-forming agent and/or the formation of foreign particles caused by aggregation of the micropore-forming agent, the inventors of the present invention have discovered that the use of a micropore-forming agent in combination with a residual elongation-improver can solve the above problems and improve both the process stability of the production of the multifilament composite yarn and the hand of the resultant bulky composite yarn, and the present invention has been completed on the basis of the discovery.

The bulky polyester multifilament composite yarn of the present invention comprises two types of polyester filaments (FA) and (FB) differing from each other in average filament length,

- the polyester filaments (FA) being formed from a polyester resin that contains from 0.1 to 9.0% by mass of a micropore-forming agent and from 0.5 to 5.0% by mass of a residual elongation-improver based on the mass of the polyester resin, and
- the polyester filaments (FA) having an average filament length that is from 1.07 to 1.40 times the average filament length of the polyester filaments (FB).

For the bulky polyester multifilament composite yarn of the present invention, the polyester filaments (FA) preferably have a single filament size of 1.5 dtex or less.

For the bulky polyester multifilament composite yarn of the present invention, the micropore-forming agent preferably contains at least one compound selected from the group consisting of polyethers having a polyoxyalkylene group, metal organic sulfonates and metal-containing phosphorus compounds.

For the bulky polyester multifilament composite yarn of the present invention, the residual elongation improver preferably contains a polymer obtained by addition polymerization of an unsaturated monomer and having a molecular weight of 2,000 or more.

For the bulky polyester multifilament composite yarn of the present invention, the elongation improvement ratio I defined by the following formula (I) of the polyester filaments (FA) is preferably 50% or more:

$$I(\%)=[EL_A/(EL_0-1)]\times 100 \quad (I)$$

wherein $EL_A$ is a single filament elongation of the undrawn filaments of the polyester filaments (FA), and $EL_0$ is a single filament elongation of undrawn polyester filaments produced from the same composition as that of the undrawn filaments of the polyester filaments (FA) under the same conditions as those under which the undrawn filaments of the polyester filaments (FA) have been produced except that the composition contains no residual elongation improver.

For the bulky polyester multifilament composite yarn of the present invention, the residual elongation improver preferably contains at least one polymer substance selected from the group consisting of polymers or copolymers of methyl methacrylate, isotactic polymers or copolymers of styrene compounds, syndiotactic polymers or copolymers of styrene compounds and polymers or copolymers of methylpentene compounds.

A process for producing a bulky polyester multifilament composite yarn of the present invention comprises: melt extruding a polyester composition (PA) containing a polyester resin, from 0.1 to 9.0% by mass of a micropore-forming agent and from 0.5 to 5.0% by mass of a residual elongation-improver based on the mass of the polyester resin, and a polyester composition (PB) differing from the polyester composition (PA) in composition respectively through spinnerets for melt spinning; cooling and solidifying the resultant two types of melt-extruded filaments; taking up the two types of undrawn filaments at a rate of from 2,500 to 6,000 m/min while the two types of the undrawn filaments are being combined and bundled; drawing and heat setting or heat setting without drawing the undrawn combined filament bundle thus obtained by a draw ratio of from 1.5 to 2.5, and applying a relaxation heat treatment to the combined filament bundle thus obtained to adjust the average filament length of the polyester filaments (FA) in the bundle formed from the composition (PA) to from 1.07 to 1.40 times the average filament length of the polyester filaments (FB) therein formed from the composition (PB), and to cause the combined filament bundle to be bulky.

BEST MODE FOR CARRYING OUT THE INVENTION

The bulky polyester multifilament composite yarn of the present invention comprises two types of polyester multifilaments (FA) and (FB) differing from each other in average filament length. The multifilaments (FA) and (FB) are each formed from a polyester resin that is produced by polycondensation of a dicarboxylic acid component containing at least one of terephthalic acid and naphthalenedicarboxylic acid as a principal component (85% by mole or more), and a glycol component containing at least one alkylene glycol such as ethylene glycol, trimethylene glycol and/or tetramethylene glycol as a principal component (85% by mole or more). The dicarboxylic acid component for the production of the polyester resin may contain, in addition to the above principal compounds, at least one dicarboxylic acid different therefrom. Moreover, the glycol component may contain, in addition to the above principal compounds, at least one diol compound different therefrom. Examples of the other dicarboxylic acids include isophthalic acid, succinic acid, adipic acid, sebacic acid, cyclohexanedicarboxylic acid and 5-sodium sulfoisophthalic acid. Examples of the other diol compounds include diethylene glycol, neopentyl glycol, 1,6-hexanediol and cyclohexanedimethanol.

Examples of the polyester resin preferably used in the present invention include at least one resin selected from poly(ethylene terephthalate), poly(trimethylene terephthalate), poly(tetramethylene terephthalate) and poly(ethylene 2,6-naphthalenedicarboxylate). Of these polyester resins, poly(ethylene terephthalate)-based polyester is preferred.

Polyesters for the filaments (FA) and (FB) may optionally contain various additives such as delustering agents, thermal stabilizers, ultraviolet-ray absorbers, terminal stoppers and fluorescent brighteners.

The bulky composite yarn of the invention is formed from two types of polyester filaments (FA) and (FB) differing from each other in average filament length. The average filament length of the polyester filaments (FA) is adjusted to be from 1.07 to 1.40 times that of the other polyester filaments (FB). The polyester resin forming the polyester filaments (FA) having a larger filament length contains from 0.1 to 9.0% by mass of a micropore-forming agent and from 0.5 to 5.0% by mass of a residual elongation improver based on the mass of the polyester resin. When the content of the micropore-forming agent in the polyester filaments is less than 0.1% by mass, the effect of improving the feeling of the bulky composite yarn becomes insufficient. When the content exceeds 9.0% by mass, the single filament strength of the polyester filaments (FA) thus obtained becomes insufficient, and the effect of improving the feeling of the bulky composite yarn thus obtained sometimes becomes insufficient. On the other hand, when the content of the residual elongation improver is less than 0.5% by mass, the effect of improving the feeling of the bulky composite yarn thus obtained becomes insufficient, and the thickness of the polyester filaments (FA) is restricted. As a result, decreasing the single filament thickness of the polyester filaments (FA) to, for example, 1.0 dtex or less, becomes difficult. Moreover, the production efficiency becomes industrially insufficient. Furthermore, when the content exceeds 5.0% by mass, single filament breakage often takes place during spinning of the polyester filaments (FA), and the stability of the spinning step becomes insufficient.

In the present invention, the function of the micropore-forming agent is as explained below. When a polyester yarn containing fine particles of the micropore-forming agent is subjected to alkali reduction, the particles are removed from the yarn surface so that micropores (recesses, craters) are formed by the removal traces.

The micropore-forming agent preferably used in the present invention contains, for example, at least one compound selected from polyether compounds having a polyoxyalkylene group, metal organic sulfonates and metal-containing phosphorus compounds.

When a polyoxyalkylene group-containing polyether compound for the micropore-forming agent has an average molecular weight of from 5,000 to 30,000, micropores having preferred shapes and dimensions can be obtained on the peripheral surface of the polyester filaments. Moreover, a polyoxyethylene-based polyether of the following general formula (A) is preferred as the polyoxyalkylene group-containing polyether:

$$Z((CH_2CH_2O)_n-(R^1O)_m-R^2)_k \quad (A)$$

wherein Z represents an organic compound residue having from 1 to 6 active-hydrogen atoms and a molecular weight of 300 or less, $R^1$ represents an alkylene group having at least 6 carbon atoms, $R^2$ represents a hydrogen atom, a hydrocarbon group having from 1 to 40 carbon atoms or an acyl group having from 2 to 40 carbon atoms, k represents an integer of from 1 to 6, n represents an integer of n×k=70 or more, and m represents an integer of 0, or 1 or more.

The polyoxyethylene polyether represented by the general formula (A) specifically includes-a polyethylene glycol and a nonrandomly copolymerized polyoxyethylene polyester disclosed in Japanese Patent Publication No. 2,865,846. The stage at which the polyester resin is made to contain a polyoxyalkylene group-containing polyether for the micropore-forming agent may be any one of the stages prior to melt spinning the polyester resin. For example, the polyether may be added to any of the raw materials for preparing the polyester by polycondensation, or it may be added to the polycondensation system of the polyester, or it may be added to the polyester resin obtained by polycondensation. The content of the polyoxyalkylene group-containing polyether in the polyester filaments (FA) is preferably from 0.1 to 9.0% by mass, more preferably from 1.0 to 7.0% by mass based on the mass of the polyester resin.

Furthermore, as the metal organic sulfonate for forming micropores, a metal sulfonate represented by the following formula (B) or (C) is preferred:

$$R^3SO_3M^1 \quad \text{(B)}$$

(C)

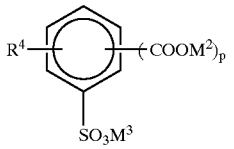

In the formula (B), $R^3$ represents an alkyl group having from 3 to 30 carbon atoms or an alkylaryl group having from 7 to 40 carbon atoms, and $M^1$ represents an alkali metal atom or an alkaline earth metal atom, preferably a sodium or potassium atom.

Specific examples of the metal sulfonate of the formula (B) include sodium stearylsulfonate, sodium octylsulfonate, sodium dodecylsulfonate, sodium dodecylbenzenesulfonate, and a mixture of sodium alkylsulfonates having an average number of carbon atoms of 14.

In the formula (C), $M^2$ and $M^3$ are respectively represent a monovalent or bivalent metal atom, preferably an atom of alkali metals, or alkaline earth metals, manganese, cobalt, zinc, $R^4$ represents a hydrogen atom organ ester-forming functional group, and p represents an integer of 1 or 2.

Examples of the metal sulfonate of the formula-(C) include such compounds disclosed in Japanese Examined Patent Publication (Kokoku) No. 61-31231 sodium 3-carbomethoxybenzene sulfonate-5-sodium carboxylate and sodium-3-hydroxyethoxycarbonylbenzene sulfonate-5-½ magnesium carboxylate.

The stage at which the polyester resin is made to contain the above metal sulfonate salt may be any of the stages prior to melt spinning the polyester resin. For example, the metal sulfonate salt may be added to any of the raw materials for preparing the polyester resin, or it may be added during polycondensation of the polyester, or it may be added to the polyester resin after polymerization. In addition, when the above metal sulfonate salt is to be used, addition of the metal sulfonate in an excessive amount tends to lower the spinnability in comparison with the addition of the above polyoxyalkylene polyether. Accordingly, the addition amount is preferably 2.5% by mass or less, particularly preferably 1.5% by mass or less based on the mass of the polyester resin.

Furthermore, insoluble fine particles to be explained below are preferably used as a metal-containing phosphorus compound for the micropore-forming agent. A phosphorus compound-of the following formula (D) and an alkaline earth metal compound are added to the polyester polycondensation system in advance, without reacting the compounds, and are reacted in the system to give insoluble particles precipitated in the polyester resin:

(D)

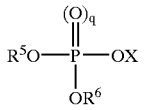

wherein $R^5$ and $R^6$ respectively and independently from each other represent a hydrogen atom or a monovalent organic group, preferably the organic group, $R^5$ and $R^6$ may be the same as or different from each other, X represents a metal atom, a hydrogen atom or a monovalent organic group, preferably a metal atom selected from alkali metal atoms and alkaline earth metals, particularly preferably $Ca_{1/2}$, and q represents an integer of 0 or 1.

Examples of the phosphorus compound include orthophosphoric acid, phosphoric acid triesters such as trimethyl phosphate and triphenyl phosphate, phosphoric acid mono- and diesters such as methyl acid phosphate, ethyl acid phosphate and butyl acid phosphate, phosphorous acid, phosphorous acid triesters such as trimethyl phosphite, triethyl phosphite and tributyl phosphite, phosphorous acid mono- and diesters such as methyl acid phosphite, ethyl acid phosphite and butyl acid phosphite, phosphorous compounds derived by reacting the above phosphorus compounds with a glycol and/or water, and metal-containing phosphorus compounds obtained by reacting the above phosphorus compounds with a given amount of a compound of an alkali metal such as Li, Na or K, or a given amount of a compound of an alkaline earth metal such as Mg, Ca, Sr or Ba.

Examples of the alkaline earth metal compound to be reacted with the above phosphorus compounds to form insoluble fine particles of metal-containing phosphorus compounds include acetic acid salts of alkaline earth metals, organic carboxylic acid salts such as benzoic acid salts, inorganic acid salts such as nitric acid salts and sulfuric acid salts, halogen compounds such as chlorides, and chelate compounds such as ethylenediaminetetraacetic acid complex salts. Organic carboxylic acid salts soluble in ethylene glycol are particularly preferred. Ca is particularly preferably used as an alkaline earth metal. Calcium acetate can be mentioned as a specific example.

In order to increase the yield of the micropore-forming agent in reacting any of the phosphorus compounds with an alkaline earth metal compound, it is important to specify the ratio of an amount of the phosphorus compound to be used to an amount of the alkaline earth metal compound. That is, it is suitable that the ratio of a total of an amount of the metal, in terms of equivalent, present in the phosphorus compound and an amount of the metal, in terms of equivalent, present in the alkaline earth metal compound to a molar amount of the phosphorus compound be from 2.0 to 3.2. When the ratio is less than 2.0, the softening point of the polyester thus obtained is sometimes lowered. On the other hand, when the ratio exceeds 3.2, the reaction product sometimes forms coarse particles. The bulky composite yarn obtained using the reaction product sometimes gives an unsatisfactory feeling. Moreover, the process stability during spinning multifilaments sometimes becomes inadequate.

In addition, when the above metal-containing phosphorus compound is to be formed in the polyester polycondensation system, the polymerization degree of the polyester thus obtained sometimes becomes insufficient when the production amount is intended to increase. Moreover, coarse particles of inactive reaction products are sometimes formed. Accordingly, the content of the metal-containing phosphorus compound is preferably 3.0% by mass or less based on the mass of the polyester, more preferably 2.5% by mass or less in order to obtain a bulky composite yarn that has a delicate feeling and that shows a color-deepening effect during dyeing.

An unsaturated monomer addition product polymer having a molecular weight of 2,000 or more is preferably used as a residual elongation improver to be used in combination with the micropore-forming agent in the present invention. The residual elongation improver is substantially incompatible with the polyester, and has a thermal deformation temperature (T) of from 90 to 150° C. Specific examples of the residual elongation improver include a poly(methyl methacrylate)-based polymer, an isotactic polystyrene-based polymer, a syndiotactic polystyrene-based polymer and a polymethylpentene-based polymer. In order to make these polymers function as a stress-supporting material independently of the polyester and show the effect of improving the residual elongation, the polymers must manifest structural viscoelasticity. The polymers therefore desirably have a molecular weight of 2,000 or more, preferably 8,000 or more. On the other hand, when the polymers have an excessively large molecular weight, they show deteriorated stringiness during spinning, and they are wound with difficulty. Moreover, the filaments thus obtained sometimes show deteriorated mechanical properties. Accordingly, the polymers have a molecular weight of preferably 200,000 or less, more preferably 150,000 or less.

More preferred examples of the addition product polymer for a residual elongation improver include the following polymers: a poly(methyl methacrylate)-based copolymer having a molecular weight of from 8,000 or more to 200,000 or less, and showing a melt index (M. I.) of from 0.5 to 15.0 g/min measured under the conditions (230° C., load of 3.8 kgf) defined by ASTM-D1238; an isotactic polystyrene-based copolymer containing styrene as its principal component; a polymethylpentene having a molecular weight of from 8,000 to 200,000, and showing a M. I. (based on ASTM-D1238, 260° C., 5.0 kgf) of from 5.0 to 40.0 g/10 min and its derivative; and a syndiotactic polystyrene (crystalline) having a molecular weight of from 8,000 to 200,000 and showing a M. I. (based on ASTM-D1238, 300° C., 2.16 kgf) of from 6.0 to 25.0 g/10 min and its derivative. Because these polymers are excellent in thermal stability and dispersion state stability at spinning temperature of the polyester, they are preferably used.

There is no specific limitation on the method of making the polyester resin contain the residual elongation improver. For example, the residual elongation improver may be added to and mixed with the polyester resin at the final stage of polymerization, or the polyester resin and residual elongation improver may be melted and mixed with each other after polymerization or before spinning. Alternatively, the residual elongation improver in a molten state may be added as a side stream to a main stream composed of the polyester in a molten state and mixed together through a dynamic or static mixing apparatus of a melt spinning system. Moreover, the polyester resin and the residual elongation improver may be mixed in a chip state, and the mixed chips may be melt spun without further processing. In particular, the following procedure may also be conducted: part of the polyester is taken up from a polyester feed line on the direct polyester polymerization-direct spinning line; the taken-up polyester is used as a matrix, and a residual elongation improver is kneaded with and dispersed in the matrix; the resin mixture is then returned to the initial polyester resin feed line, and the polyester resin is mixed with the resin mixture through a dynamic or static mixing apparatus.

For the bulky polyester multifilament composite yarn of the present invention, the elongation improvement ratio I defined by the following formula (I) of the polyester filaments (FA) is preferably. 50% or more, more preferably from 65 to 300%:

$$I(\%)=[EL_A/(EL_0-1)]\times 100 \quad \text{(I)}$$

wherein $EL_A$ is a single filament elongation of the undrawn filaments of the polyester filaments (FA), and $EL_0$ is a single filament elongation of undrawn polyester filaments produced from the same composition as that of the undrawn filaments of the polyester filaments (FA) under the same conditions as those under which the undrawn filaments of the polyester filaments (FA) have been produced except that the composition contains no residual elongation improver.

When the elongation improvement ratio is less than 50%, the composite yarn thus obtained sometimes hardly manifests excellent bulkiness and the feeling that a core-sheath structure has.

As long as the filaments (FB) contained in the composite yarn of the present invention, and having a shorter average filament length, can manifest a predetermined difference of an average filament length to be described later between the polyester filaments (FB) and the polyester filaments (FB), there is no limitation on the type and composition of the polyester resin forming the two types of the polyester filaments (FA) and (FB). Moreover, the filaments (FB) may contain the residual elongation improver with a content smaller than that of the filaments (FA). However, in order to adjust the difference of the average filament length to a predetermined length, it is preferred that the filaments (FB) substantially contain no residual elongation improver mentioned above. Moreover, the filaments (FB) may contain additives other than the residual elongation improver as long as the objects of the present invention are not impaired.

For the composite yarn of the invention, in addition to the above requirement, the average filament length of the filaments (FA) must be from 107 to 140% of that of the filaments (FB), preferably from 112 to 125% thereof. The average filament length designates the average filament lengths of the filaments (FA) and the filaments (FB) contained in the composite yarn after conditioning the composite yarn by treating the composite yarn with boiling water at 100° C. for 30 minutes without load. Specifically, the average length is measured by the following procedure.

The composite yarn is treated with boiling water at 100° C. for 30 minutes without load, dried for a day at room temperature, and cut into pieces (n=3) each having a length of 5 cm under load of 0.294 mN/dtex (1/30 g/de). Each filament of the filaments (FA) and filaments (FB) in a mutually interlaced and combined state in the composite yarn is opened, and the length is measured under load of 0.88 mN/dtex (0.1 g/de). The average length of the filaments (FA) and that of the filaments (FB) are calculated. The ratio of filament length is subsequently calculated from the following formula (II):

Ratio of filament length (%)=[(average filament length of (FA)/average filament length of (FB))×100 (II)

When the ratio of the average filament length of the filaments (FA) to that of the filaments (FB) is less than 107%, the bulkiness of the bulky composite yarn thus obtained and the touch of the sheath portion of the composite yarn formed with the filaments (FA) become unsatisfactory. On the other hand, when the ratio exceeds 140%, mutual combination property of the filaments (FA) and (FB) is decreased, and the uniformity in the appearance of the composite yarn becomes insufficient.

The total thickness of the filaments (FA) and that of the filaments (FB) are preferably from 30 to 80 dtex and from 50 to 100 dtex, respectively, though there is no specific limitation on each of the total sizes. The individual filament thickness of the filaments (FA) and that of the filaments (FB) are preferably from 0.5 to 6.0 dtex and from 0.2 to 2.0 dtex, respectively. Particularly when the filaments (FA) are composed of extremely thin filaments having an individual filament thickness of 1.0 dtex or less, a composite yarn having an excellent hand as well as the above effect of improving the hand can be efficiently provided due to the excellent spinning stability.

When such a process, as described below, is employed, the bulky polyester multifilament composite yarn of the present invention can be produced with excellent process stability during yarn production and high efficiency. That is, a polyester composition (PA) containing a polyester resin, from 0.1 to 9.0% by weight of the micropore-forming agent and from 0.5 to 5.0% by weight of the residual elongation-improver based on the weight of the polyester resin, and a polyester. composition (PB) substantially containing no residual elongation-improver are melt extruded at temperature of from 275 to 295° C. through spinnerets which may be the same as or different from each other but are preferably the same as each other for the purpose of enhancing the quality of the composite yarn thus obtained. The melt-extruded filamentary resin melt streams are cooled and solidified by conventionally blowing a cooling air. The solidified filaments are bundled while an oiling agent is being applied to the filaments. The bundled filaments are optionally combined and interlaced through an interlacing apparatus, and then taken up at a rate of from 2,500 to 6,000 m/min. The taken-up spun undrawn filament bundle, preferably the melt-spun undrawn filament bundle, in which the individual filament thickness of the undrawn filaments. (FA) is adjusted to 1.5 dtex or less, is, preferably before winding, continuously drawn at a draw ratio of from 1.5 to 2.5, and/or heat set at temperature of from 90 to 180° C., or heat set at the temperature mentioned above without drawing. The filament bundle is subsequently subjected to relaxation heat treatment so that the difference in average filament length between the two types of filaments (FA) and (FB) in the filament bundle thus obtained is manifested.

The drawing ratio, heat set conditions, relaxation heat treatment conditions, and the like vary in response to the type and composition of the polyester resin, the type and amount of the micropore-forming agent, the type and amount of the residual elongation improver, the spinning conditions, the take-up rate, and the like. The difference in average filament length between the filaments (FA) and filaments (FB) should be appropriately controlled to 7 to 10% of the average filament length of the filaments (FB).

Various bulky composite yarns can be produced by subjecting the bulky composite yarn of the present invention to a processing procedure in which simultaneous drawing and false twisting, nonuniform drawing and IL air treatment of the melt-spun undrawn filament bundle. Moreover, various bulky composite textured yarns can be produced by further compositing the bulky composite yarn of the invention with a filament bundle produced by a separate procedure, by an air treatment or doubling, prior to, during or subsequently to the above processing procedure.

EXAMPLES

The present invention will be more specifically explained below by making reference to the following examples. In addition, the following tests were conducted in the examples.

(1) Ratio of Filament Length

A bulky composite yarn is treated in boiling water at 100° C. for 30 minutes under no load, dried for a day at room temperature under no load, and cut into pieces (n=3) each having a length of 5 cm under load of 0.294 mN/dtex (1/30 g/de). The filaments (FA) and filaments (FB) in a mutually interlaced and combined state of each sample are separated into individual filaments, and the lengths of the individual filaments are measured under load of 0.88 mN/dtex (0.1 g/de). The average length of the filaments (FA) and that of the filaments (FB) are calculated. The ratio of filament length is subsequently calculated from the equation (II):

Ratio of filament length (%)=[(average filament length of (FA)/average filament length of (FB))×100 (II)

(2) Ultimate Elongation of Melt Spun Filament

A melt-spun filaments were left to stand for a whole day and night at 25° C. and humidity of 60% (constant temperature and constant humidity), and cut to give a filament sample 100 mm long. The sample was set on a tensile testing machine manufactured by Shimazu Corporation, and the ultimate elongation at a tensile breakage was measured at a stretching rate of 200 mm/min.

(3) Elongation Improvement Ratio I (%)

The elongation improvement ratio I of the polyester filaments (FA) is calculated from the equation (I):

$$I(\%)=[EL_A/(EL_0-1)]\times 100 \quad \text{(I)}$$

wherein $EL_A$ is an individual filament ultimate elongation of the undrawn filaments (FA') of the polyester filaments (FA) containing a residual elongation-improver, and $EL_0$ is an individual filament ultimate elongation of undrawn polyester filaments produced from the same composition as that of the undrawn filaments (FA') under the same conditions as those under which the undrawn filaments (FA') have been produced, except that the undrawn polyester filaments contain no residual elongation-improver.

(4) Diameter of Micropores Formed by Alkali Weight Reduction Treatment

A sample of a bulky composite yarn is subjected to alkali weight reduction treatment with a weight reduction of from 5 to 30%. The treated sample is cut in a direction vertical to the longitudinal direction to give pieces having a length of several millimeters. A plurality of cut multifilaments thus obtained are placed on a slide glass, and platinum is deposited by sputtering on the peripheral surfaces of the cut filaments in the sample under the condition of 10 mA×2 minutes. A magnified photograph (×15,000) of the peripheral surfaces of the cut filaments on which platinum has been deposited is taken with an electron microscope. The diameters of ten micropores (n=10) present on the cut filament surfaces were measured, and the average diameter of the micropores is calculated.

Example 1

A filament bundle for polyester filaments (FA) was prepared by the following procedure.

After completion of a transesterification reaction for polyester polymerization, a micropore-forming agent listed in Table 1 was added to the reaction system. The reaction mixture was subjected to a polycondensation reaction to obtain a poly(ethylene terephthalate) resin composition having an intrinsic viscosity of 0.64. The resin composition was dried at 160° C. for 5 hours, fed to a uniaxial Fulbright type melt extruder having a diameter of 25 mm, and melted at 300° C. A residual elongation improver in a molten state listed in Table 1 was introduced, as a side stream, into the main stream of the molten polyester composition in the extruder. The melt mixture was uniformly dispersed and mixed through a 12 -step static mixer, passed through a metal fiber filter provided directly above a spinnerets and having a pore size of 25 μm, and melt-extruded through the spinneret at 285° C. having 48 circular extrusion nozzles that have a diameter of 0.3 mm and a land length of 0.8 mm. The injected filamentary molten flow was cooled and solidified by blowing air at 25° C. at a speed of 0.23 m/sec from a side blowing cooling cylinder for the melt-spun filaments provided below the spinneret over a length of from 9 to 100 cm. An oiling agent was applied to the peripheries of the solidified filaments in an amount of from 0.25 to 0.30% by weight, and the filaments were wound at a rate listed in Table 1. Table 1 shows the results of evaluating the filaments (FA) thus obtained.

Separately, POY (intermediate oriented yarn) filaments prepared from a poly(ethylene terephthalate) and having a yarn count of 65 dtex/15 fil, a tensile strength of 2.38 cN/dtex and an ultimate elongation of 140% were used as filaments (FB). The filaments (FA) and (FB) were doubled, and the bundle of the doubled filaments was fed to an interlacing nozzle provided between a supply roller and a first take-up roller at a rate of 375 m/min with an overfeed ratio of 1.5%. The bundle was then guided to a heater, heated to 140° C. introduced into a DTY machine (the false twisting unit of the machine being a friction disc) provided to the downstream of the heater, and drawn and false twisted at a D/Y ratio of 2.0 (D: peripheral speed of the disc, Y: speed of the filament bundle) and a draw ratio of 1.6 to obtain a false twisted bulky composite yarn.

A twill fabric having a basis weight of 190 g/m$^2$ was prepared from the bulky composite yarn. The twill fabric was consecutively subjected to a prerelaxation treatment, a principal relaxation-treatment, a preset treatment and a 20% alkali weight reduction treatment. The resultant woven fabric was dyed at 130° C., and subjected to a final set. Table 1 shows the results of evaluating the bulky composite yarn and the woven fabric thereof.

TABLE 1

Example 1

| | Filaments (FA) | | | | | | | | | | | | | |
|---|---|---|---|---|---|---|---|---|---|---|---|---|---|---|
| | Micropore-forming agent | | Residual elongation-improver | | Winding | Melt-spun undrawn filaments | | Drawn filaments | | Bulky multifilament composite yarn | | | | |
| Ex.* No. | Type | Amount (wt. %) | Type | Amount (wt. %) | speed (m/min) | Individual filament thickness (dtex) | Ultimate Elongation (%) | Elongation improvement ratio (I) (%) | Individual filament thickness (dtex) | Ratio of filament length (%) | Spinnability and processability | Micropore diameter (μm) | Hand | Note |
| 1 | A1 | 0.7 | B1 | 2.0 | 3000 | 1.25 | 292 | 116 | 0.78 | 130 | Good | 0.57 | Good | Invention |
| 2 | A1 | 0.7 | — | — | 3000 | 1.25 | 140 | — | 0.78 | 102 | Good | 0.46 | Not good | Comp. Example |
| 3 | A1 | 0.7 | B1 | 3.5 | 4500 | 1.25 | 235 | 193 | 0.78 | 119 | Good | 0.61 | Good | Invention |
| 4 | A1 | 0.7 | B1 | 6.0 | 4500 | 1.25 | 283 | 254 | 0.78 | 128 | Not good to some extent | 0.63 | Good | Invention |
| 5 | A2<br>A1 | 1.2<br>0.7 | B2 | 0.3 | 3000 | 1.25 | 155 | 15 | 0.78 | 105 | Good | 0.89 | Not good | Comp. Example |
| 6 | A1 | 0.7 | B2 | 2.0 | 3500 | 1.25 | 261 | 118 | 0.78 | 125 | Good | 1.10 | Good | Invention |
| 7 | A3<br>A1 | 0.06<br>0.03 | B3 | 3.0 | 3000 | 1.25 | 215 | 93 | 0.78 | 116 | Good | 0.08 | Not good | Comp. Example |
| 8 | A1 | 0.8 | B1 | 1.5 | 3500 | 1.00 | 276 | 130 | 0.63 | 127 | Good | 0.57 | Good | Invention |
| 9 | — | — | B1 | 1.5 | 3500 | 1.00 | 259 | 116 | 0.63 | 120 | Good | 0.06 | Not good | Comp. Example |

*: Ex. = Experiment

Note of Table 1

Abbreviations of the micropore-forming agents and residual elongation improvers are described below.

A1: a sodium alkylsulfonate-having an average number of carbon atoms of 14

A2: a poly(ethylene glycol) having an average molecular weight of 12,000

A3: a poly(ethylene glycol) having an average molecular weight of 20,000

A4: Na benzene sulfonate-3,5-$Mg_{1/2}$ dicarboxylate

B1: poly(methyl methacrylate) copolymer (PMMA) having a thermal deformation temperature (T) of 121° C. and a molecular weight of 150,000

B2: a syndiotactic polystyrene (PS) showing a T of and having a molecular weight of 80,000

B3: a polymethylpentene polymer (PMP) comprising 4-methylpentene-1 as its principal component and having a T of 83° C.

Because a residual elongation improver was not added to FA in Experiment No. 2, the filament length, ratio of the resultant texturized yarn thus obtained was significantly low; the composite yarn thus obtained exhibited an insufficient bulkiness and an unsatisfactory touch derived from reduction traces. In each of Experiment Nos. 1, 3, 6 and 8, a residual elongation-improver was added in an amount defined by the present invention. As a result, both a satisfactory decrease in the residence time due to a high extrusion rate and a high melt-spinning rate and a satisfactory small thickness of the filaments were attained, and a sufficient bulkiness and a delicate touch thereof could be realized. In Experiment No. 4, because a residual elongation-improver was excessively added, the effect of improving the elongation was significant. However, the processability was not good, and yarn breakage particularly often took place during false twisting due to a high thermal deformation temperature of the residual elongation-improver. On the other hand, because the residual elongation-improver was added in an insufficient amount in Experiment No. 5, a difference in physical properties between FB and FA was insufficient, and the composite yarn exhibited insufficient bulkiness. In Experiment No. 7, addition amounts of a metal sulfonate salt and a poly(ethylene glycol) having a molecular weight of 20,000 in a mixture were each insufficient, and the composite fabric did not have a delicate touch because effective micropores were not-formed by the alkali weight reduction treatment, although the bulkiness of the composite yarn was adequately manifested by the residual elongation-improver. In Experiment No. 9 in which a residual elongation-improver was added to a polyester containing no micropore-forming agent, the filaments exhibited an effect of improving elongation that is somewhat low in comparison with that of the filaments prepared from a polyester containing a micropore-forming agent, but the woven fabric exhibited a sufficient bulkiness. However, the woven fabric did not manifest a delicate touch.

Example 2

A poly(ethylene terephthalate) to which a micropore-forming agent and a residual elongation-improver listed in Table 2 were added was melt spun at a rate of 5,000 m/min in the same manner as in Example 1 to produce a medium-oriented filament bundle of 48 dtex/48 filaments. The filament bundle for filaments (FA) was heat treated with a roller at 100° C., heat treated at an overfeed rate of 2% by passing the bundle through a noncontact heater at 180° C., and introduced into a Taslan nozzle at an overfeed rate of 4%. Separately, a bundle of isophthalic acid-poly(ethylene terephthalate) copolymer multifilaments (45 dtex/15 filaments) having a shrinkage of 15% when treated with boiling water at 100° C. was used as an undrawn filament bundle for filaments (FB.). The undrawn filament bundles for filaments (FA) and (FB) were paralleled, introduced into a Taslan nozzle at an overfeed rate of 2%, subjected to a rotation-mixing treatment under air pressure of 5 kg/cm$^2$, and wound at a speed of 600 m/min.

The resultant bulky composite yarn was woven in the same manner as in Example 1 to obtain a satin woven fabric having a basis weight of 120 g/m$^2$. The fabric compatibly had both a high bulkiness and a delicate touch. Moreover, the processability of melt-spinning and texturing was good. Table 2 shows the results.

TABLE 2

| | | | | | Filaments (FA) | | | | | | |
|---|---|---|---|---|---|---|---|---|---|---|---|
| | | | | | | Melt-spun filament | | | | | |
| | | | | | | Indi- | | Bulky composite yarn | | | |
| Experiment No. | Micropore-forming agent Type | Micropore-forming agent Amt. (wt. %) | Residual elongation improver Type | Residual elongation improver Amt. (wt. %) | Winding speed (m/min) | vidual filament thickness (dtex) | Elongation (%) | Ratio of filament length (%) | Spinnability and processability | Diameter of micropore (μm) | Hand |
| 10 | A1 | 0.7 | B1 | 3.0 | 5000 | 1.0 | 121 | 124 | Good | 0.54 | Good |

Examples 3 to 4

Nozzle holes A (48 circular nozzle holes each having a nozzle hole diameter of 0.25 mm and a land length of 0.5 mm) and nozzle holes B (15 or 24 circular nozzle holes each having a nozzle hole diameter of 0.38 mm and a land length of 0.8 mm) formed by perforating one the same spinneret were used. Poly(ethylene terephthalate) chips containing a micropore-forming agent listed in Table 3 and having an intrinsic viscosity of 0.64 were blended with a residual elongation improver listed in Table 3, and the blend was melted by a melt extruder and extruded through the nozzle holes A. Separately, poly(ethylene terephthalate) chips having an intrinsic viscosity of 0.64 were melted by another melt extruder, and extruded through the nozzle holes B at a nozzle temperature of 283° C. Both types of filaments were taken up in the same manner as in Example 1, and an oiling agent was applied to the filaments with an oiling roller, followed by bundling with a snell guide. The bundles were passed through an interlacing apparatus under air pressure of 2 kg/cm$^2$ to to combine and interlace them, and the combined bandle was wound at a speed shown in Table 3.

The resultant melt-spun filament bundle was simultaneously drawn and false twisted under the same conditions as in Example 1. The resultant bulky composite yarn was treated in the same manner as in Example 1 to give a woven fabric.

The spinnability in Example 3 was good. Moreover, the processability of the bulky composite yarn was excellent though the filaments (FA) had a small, thickness, because the filaments (FA) and, filaments (FB) formed a combined state had periodic stranding points during the interlacing step. Furthermore, the resultant false twisted composite yarn had a sheath/core double structure uniformly formed with the filaments (FA) and filaments (FB), and contained no partially untwisted portion. A woven fabric prepared from the composite yarn had good quality, exhibited a high bulkiness, and a delicate touch.

Separately, in Example 4, since both polyesters for filaments (FA) and (FB) were made to contain an elongation improver, filaments (FA) and (FB) thus obtained sufficiently differed from each other in ultimate elongation even when melt-spun at a higher speed than in Example 3. A finally obtained woven fabric had a good hand. Table 3 shows the evaluation results.

Example 5

Bundle of filaments (FA) and (FB) were prepared by a melt-extrusion through one and the same spinneret in the same manner as in Example 3, and taken up at a speed of 2,500 m/min. The resultant bundles were doubled, drawn between a first and a second godet roller at room temperature at a draw ratio of 1.32, and wound at a speed of 3,300 m/min. Using a pin, the resultant filament bundle was drawn at a draw ratio of 1.2 without fixing the drawing point, further drawn at a draw ratio of 1.35 in a noncontact heater at 180° C., and heat set to produce a thick and thin multifilament yarn. A woven fabric was prepared from the composite yarn. Thick portions and thin portions were distributed in the woven fabric with very small pitches due to the effects of the interlacing points formed by interlacing during melt spinning procedure and of the pin drawing, and the woven fabric had an extremely excellent bulkiness and a delicate touch. Table 3 shows the results.

TABLE 3

| | Filaments (FA) | | | | | | | | | | | | | | | |
|---|---|---|---|---|---|---|---|---|---|---|---|---|---|---|---|---|
| | Type of Micropore-forming agent (wt. %) | | Type of residual elongation improver (wt. %) | | Winding speed | Individual filament thickness of melt spun undrawn yarn (dtex) | | Ultimate elongation of melt spun undrawn yarn (%) | | Individual filament thickness of drawn filaments (dtex) | | Bulky composite yarn | | | |
| | FA | FB | FA | FB | (m/min) | FA | FB | FA | FB | FA | FB | Ratio of filament length (%) | Spinnability and process-ability | Diameter of micropore (μm) | Hand |
| Ex. 3 | A1 0.7 | — | B1 1.5 | — | 3000 | 1.25 | 4.3 | 289 | 135 | 0.78 | 2.7 | 136 | Good | 0.56 | Good |
| Ex. 4 | A5 1.0<br>A1 0.5 | — | B1 3.0 | B1 1.5 | 4500 | 1.25 | 4.3 | 245 | 124 | 0.78 | 2.7 | 122 | Good | 1.26 | Good |
| Ex. 5 | A4 0.8 | — | B1 2.0 | — | G1:2500<br>G2:3300 | 1.0 | 3 | 310 | 140 | 0.6 | 1.8 | 130 | Good | 1.43 | Good |

In addition, A5 in Table 3 is a polyoxyethylene polyether represented by the formula (A) wherein Z is an ethylene glycol residue, $R^1$ is an ethylene group substituted with an alkylene group having 21 carbon atoms, $R^2$ is a hydrogen atom, m is 3 and k is 2, and has an average molecular weight of 6,930.

INDUSTRIAL APPLICABILITY

The bulky polyester multifilament composite yarn of the present invention is of high quality, and can be stably obtained because the process stability during the production thereof is excellent. Moreover, the composite yarn is useful for manufacturing a fabric having an extremely excellent delicate hand, and thus the industrial value of the present invention is extremely high.

What is claimed is:

1. A bulky polyester multifilament composite yarn comprising two types of polyester filaments (FA) and (FB) differing from each other in average, filament length, the polyester filaments (FA) being formed from a polyester resin that contains from 0.1 to 9.0% by mass of a micropore-forming agent and from 0.5 to 5.0% by mass of a residual elongation-improver based on the mass of the polyester resin, and the polyester filaments (FA) having an average filament length that is from 1.07 to 1.40 times the average filament length of the polyester filaments (FB).

2. The bulky polyester multifilament composite yarn according to claim 1, wherein the polyester filaments (FA) have a single filament size of 1.5 dtex or less.

3. The bulky polyester multifilament composite yarn according to claim 1, wherein the micropore-forming agent contains at least one compound selected from the group consisting of polyethers having a polyoxyalkylene group, metal organic sulfonates and metal-containing phosphorus compounds.

4. The bulky polyester multifilament composite yarn according to claim 1, wherein the residual elongation-improver contains a polymer obtained by addition polymerization of an unsaturated monomer and having a molecular weight of 2,000 or more.

5. The bulky polyester multifilament composite yarn according to claim 1, wherein the elongation improvement-ratio I defined by the following formula (I) of the polyester filaments (FA) is 50% or more:

$$I(\%)=[EL_A/(EL_0-1)]\times 100 \quad \text{(I)}$$

wherein $EL_A$ is a single filament elongation of the undrawn filaments of the polyester filaments (FA), and $EL_0$ is a single filament elongation of undrawn polyester filaments produced from the same composition as that of the undrawn filaments of the polyester filaments (FA) under the same conditions as those under which the undrawn filaments of the polyester filaments (FA) have been produced except that the composition contains no residual elongation improver.

6. The bulky polyester multifilament composite yarn according to claim 4, wherein the residual elongation-improver contains at least one polymer substance selected from the group consisting of polymers or copolymers of methyl methacrylate, isotactic polymers or copolymers of styrene compounds, syndiotactic polymers or copolymers of styrene compounds and polymers or copolymers of methylpentene compounds.

7. A process for producing a bulky polyester multifilament composite yarn comprising: melt extruding a polyester composition (PA) containing a polyester resin, from 0.1 to 9.0% by mass of a micropore-forming agent and from 0.5 to 5.0% by mass of a residual elongation-improver based on the mass of the polyester resin, and a polyester composition (PB) differing from the polyester composition (PA) in composition, respectively through spinnerets for melt spinning; cooling and solidifying the resultant two types of melt-extruded filaments; taking up the two types of undrawn filaments at a rate of from 2,500 to 6,000 m/min while the two types of the undrawn filaments are being combined and bundled; drawing or drawing and heat setting or heat setting without drawing the undrawn combined filament bundle thus obtained by a draw ratio of from 1.5 to 2.5, and applying a relaxation heat treatment to the combined filament bundle thus obtained, to adjust the average filament length of the polyester filaments (FA) in the bundle formed from the composition (PA) to from 1.07 to 1.40 times the average filament length of the polyester filaments (FB) therein formed from the composition (PB), and to cause the combined filament bundle to be bulky.

* * * * *

UNITED STATES PATENT AND TRADEMARK OFFICE

CERTIFICATE OF CORRECTION

PATENT NO. : 6,630,240 B2 
DATED : October 7, 2003
INVENTOR(S) : Mie Yoshimura, Katsuyuki Kasaoka and Koichi Iohara It is certified that error appears in the above-identified patent and that said Letters Patent is hereby corrected as shown below:

Title page,
Item [30], Foreign Application Priority Data, delete "Dec. 1, 2001 (JP)……2001-004785" insert -- Jan. 12, 2001 (JP)……2001-004785 --

Signed and Sealed this

Second Day of March, 2004

JON W. DUDAS
*Acting Director of the United States Patent and Trademark Office*